United States Patent [19]

Schmiedel et al.

[11] Patent Number: 4,951,018

[45] Date of Patent: Aug. 21, 1990

[54] ELECTROMAGNETIC CONTACTOR

[75] Inventors: James P. Schmiedel; Jon Hanson; Larry W. Schiffer, all of Raleigh, N.C.; Daniel P. Heckenkamp, Sussex; Thomas F. Kurland, Cedarburg, both of Wis.

[73] Assignee: Square D Company, Palatine, Ill.

[21] Appl. No.: 302,801

[22] Filed: Jan. 26, 1989

[51] Int. Cl.[5] ..... H01H 67/02

[52] U.S. Cl. ..... 335/132; 335/131; 335/202; 200/293

[58] Field of Search ..... 335/131, 132, 202; 200/293, 305

[56] References Cited

U.S. PATENT DOCUMENTS

| | | | |
|---|---|---|---|
| 3,215,800 | 11/1965 | Hurter et al. | 335/132 |
| 3,643,190 | 2/1972 | Puetz et al. | 335/132 |
| 4,253,076 | 2/1981 | Guery et al. | 335/132 |

*Primary Examiner*—Leo P. Picard
*Assistant Examiner*—Lincoln Donovan
*Attorney, Agent, or Firm*—A. Sidney Johnston; James E. Lowe, Jr.; Larry I. Golden

[57] ABSTRACT

An electromagnetic contactor includes a housing assembly that may be adapted for one, two, three or four poles. An armature is affixed to a contact carrier either by a flat leaf spring that passes through a slot in a laminated armature or by a press fit of a solid armature into the contact carrier. In one embodiment of the invention, a housing assembly snaps into a base to permit a maximum amount of automatic asssembly and a minimum number of components. These components include a base, a magnet assembly having at least one shading coil, a formed coil assembly, two symmetrically disposed springs to return a contact carrier to a neutral position when the coil is de-energized, an armature to complete the magnetic circuit that is attached to the contact carrier, a contact block that supports terminals and stationary contacts, and a contact carrier that carries one or more moving contacts into engagement with the fixed contacts. A coil spring for each contact applies a force when the electromagnet is energized to draw the removable contacts to the fixed contacts to close an electric circuit. A magnet clip secures the magnet assembly by latching in place without screws or rivets. In an alternate embodiment, a molded cantilever supports a coil assembly under spring tension.

7 Claims, 5 Drawing Sheets

ELECTROMAGNETIC CONTACTOR

BACKGROUND OF THE INVENTION

This invention relates to electromagnetic contactors. In particular, it is an improved electromagnetic contactor that is adapted for use with one, two, three or four poles.

An electrical contactor is a switch that is designed to open and close repeatedly to supply and interrupt electricity at power levels to electrical loads such as motors and the like. An electromagnetic contactor is a contactor that is caused to operate by an electromagnet. The contactor is distinguished from a relay, which typically opens and closes electrical circuits to apply and remove control signals at relatively low currents. Contactors are also distinguished from circuit breakers in that a circuit breaker is a protective device, normally operated manually or by a motor or the like, that is designed for relatively infrequent operation to open in case of an overload. Thus, a complete installation that supplies power to an electrical load will normally include a circuit breaker in series with a contactor. The circuit breaker will trip and open on an overload and thus protect both the contactor and the load from damage, while normal operation that applies power to and removes it from the load is handled by the contactor. A contactor is typically designed to operate for as many as ten million cycles, while a circuit breaker is typically designed for thousands or tens of thousands of cycles.

One example of the state of the art and electromagnetic switches is given in U.S. Pat. No. 3,643,187 entitled "Electromagnetically Operated Switch Construction." The patent No. '187 teaches contacts that are bought into engagement by energizing an electromagnet and that are separated by the force of a spring when current is interrupted to the electromagnet. The apparatus that is taught by the patent No. '187 is assembled by screws and rivets, which complicate the manufacturing process, particularly if automatic assembly or assembly by robots is contemplated.

Another example of the state of the art is given in U.S. Pat. No. 3,235,686, entitled "Magnetic Switch With Readily Removable Electromagnetic Contact Unit." The apparatus taught in the patent No. '686 is designed to make it easy to reach the contacts for service without disconnecting the power wires to the contactor. This feature represents an advantage in operations, but the device as taught in the patent No. '686 is also assembled by screws and would be difficult to assemble automatically.

U.S. Pat. No. 3,179,771, entitled "Contactor With Reciprocating Armature and Novel Resilient Clip," teaches an exposed external electromagnet and return spring. The structure taught in the patent No. '771 is assembled by screws and rivets and would be extremely difficult to adapt to automatic assembly. U.S. Pat. No. 4,525,694, entitled "Electromagnet Contactor," features a three-pole contactor that is assembled without the use of screws or rivets. However, the apparatus taught in the patent No. '694 has a separate mounting and supporting frame that is snapped to the housing of the contactor to enable it to be mounted. The patent No. '694 also teaches contacts that are held in place by a spring snap. It appears that terminal screws in the patent No. '694 do not provide protection against loosening of the contact.

SUMMARY OF THE INVENTION

It is an object of the present invention to provide a better electromagnetic contactor.

It is a further object of the present invention to provide an electromagnetic contactor that is assembled without screws or rivets.

It is a further object of the present invention to provide an electromagnetic contactor in which a stationary electromagnet and its core are secured in place by a snap-in magnet clip.

It is a further object of the present invention to provide an electromagnetic contactor in which a snap-in housing assembly covers and protects an otherwise exposed electrical contact.

It is a further object of the present invention to provide an electromagnetic contactor having terminals that are secured to a contact block by a press fit and that are further secured against accidental removal of the contacts by a stop that engages a terminal screw in the contacts.

Other objects will become apparent in the course of a detailed description of the invention.

An electromagnetic contactor includes a housing assembly that may be adapted for one, two, three or four poles. An armature is affixed to a contact carrier either by a flat leaf spring that passes through a slot in a laminated armature or by a press fit of a solid armature into the contact carrier. In one embodiment of the invention, a housing assembly snaps into a base to permit a maximum amount of automatic assembly and a minimum number of components. These components include a base, a magnet assembly having at least one shading coil, a formed coil assembly, two symmetrically disposed springs to return a contact carrier to a neutral position when the coil is de-energized, an armature to complete the magnetic circuit that is attached to the contact carrier, a contact block that supports terminals and stationary contacts, and a contact carrier that carries one or more moving contacts into engagement with the fixed contacts. A coil spring for each contact applies a force when the electromagnet is energized to draw the removable contacts to the fixed contacts to close an electric circuit. A magnet clip secures the magnet assembly by latching in place without screws or rivets. In an alternate embodiment, a molded cantilever supports a coil assembly under spring tension.

DETAILED DESCRIPTION OF THE INVENTION

Figure 1:
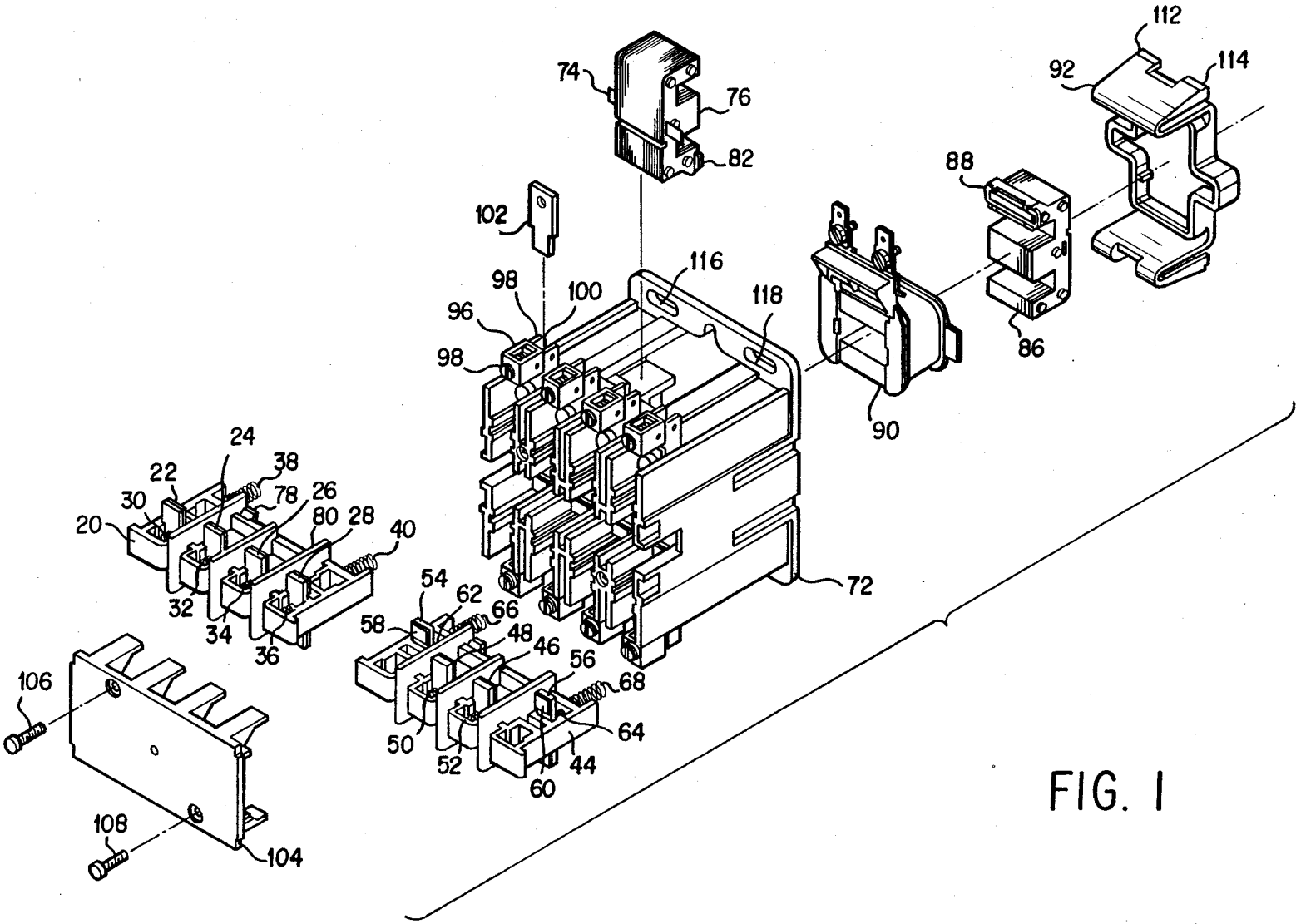
FIG. 1 is an exploded isometric view of a four-pole contactor that represents an embodiment of the present invention.

FIG. 1 is an exploded isometric view of a 4-pole contactor for the practice of the present invention. In FIG. 1 a carrier assembly 20 contains four movable contacts 22, 24, 26 and 28. Each of the movable contacts 22, 24, 26 and 28 is free to slide in the carrier assembly 20 against springs 30, 32, 34 and 36 respectively, applying a closing force to the contact carrier assembly 20 when it is in position against springs 38 and 40. The springs 38 and 40 bias the carrier assembly 20 in a direction that is opposite to the direction that will be seen later to be that of the force exerted by an electromagnet. Each of the movable contacts 22, 24, 26 and 28 is placed so as to make electrical contact on the side that is out of sight as shown. These will be seen to provide four normally open contacts.

An alternate arrangement of the carrier assembly 20 is shown in a carrier assembly 44 that is set up to have two normally open contacts and two normally closed contacts. Thus, in the carrier assembly 44 two movable contacts 46 and 48 are in positions identical to those of the movable contacts 24 and 26. Their springs 50 and 52 are forced generally to the right as shown in FIG. 1. However, the contacts 54 and 56 have been reversed so as to be normally closed. A contact surface 58 is visible on the movable contact 54 and a contact surface 60 is similarly visible on the movable contact 56. Springs 62 and 64 have been placed to exert forces opposite to those of the springs 30 and 36. Springs 66 and 68 perform the same functions as the springs 38 and 40 that are shown with carrier assembly 20.

Either the carrier assembly 20 or the carrier assembly 44 slides into a housing assembly 72 where it is held in place by a flat armature spring 74 that passes through an armature 76. The armature spring 74 engages the carrier assembly 20 in a slot defined by a tab 78 in carrier assembly 20 and a second tab that is obscured from view by a wall 80 of carrier assembly 20. The armature 76 is of ferromagnetic material that is laminated to reduce eddy currents. It includes a shading coil 82 to reduce the noise of operation on alternating current by insuring that the attractive force does not drop to zero. An identical armature 86 includes a shading coil 88 that is preferably disposed on the side opposite to the shading coil 82. The stationary armature 86 is fixed in place against a coil assembly 90 and the two are held in place by a magnet clip or base 92 that snaps into engagement with the housing 72.

The housing 72 of FIG. 1 is shown with a plurality of box lugs 96, only one of which is numbered. The box lug 96 includes a screw 98 that is attached to a fast-on connector 100, a bayonet connector adapted for quick connection to a mating connector that is attached to a wire. The mating connector is not shown. The screw 98 connects the box lug 96 and the fast-on connector 100 to a fixed contact 102. Each of the movable contacts 22, 24, 26 and 28 is connected to the fixed contact 102 when the electromagnetic contactor is energized. In the alternative, if the carrier assembly 44 has been used, the movable contacts 58 and 60 each connect to the fixed contact 102 when the electromagnetic contactor is not energized, and the movable contacts 50 and 52 each connect to the fixed contact 102 when the electromagnetic contactor is not energized. This is the arrangement with two contacts that are normally opened and two that are normally closed.

The electromagnetic contactor in FIG. 1 could function as described above, but it is preferable to add a cover 104 that is secured in place by two screws 106 and 108 to protect the carrier assemblies 20 or 44 from external contact and also to interrupt the movement of any plasma that may form when a circuit is interrupted. This will minimize the danger of arcing between adjacent contacts, and will permit use of the electromagnetic contactor to interrupt currents of as much as 240 to 360 amperes per pole without requiring arc chutes. The contacts are designed to carry 40 to 60 amperes in the steady state, and must interrupt peak currents of at least six times these values in motor service.

A particular advantage of the structure of FIG. 1 becomes apparent upon regarding its assembly. First, the fixed contacts 102 are placed in position with a contact side faced appropriately for either the carrier assembly 20 or the carrier assembly 44. The fast-on connector 100 and the box lug 96 are attached to the fixed contact 102 by the screw 98. This makes the housing 72 ready for automatic assembly. The carrier assembly 20 or 44 is provided with the appropriate movable contacts 22 et al. or 46 et al. and is placed in the housing 72. The armature spring 74 is inserted in the armature 76, which has previously had the shading coil 82 pressed or staked in place. The armature spring 74 is engaged in the carrier assembly 20 or 44 to limit its travel. The coil assembly 90 is next dropped in place, the stationary armature 86 is dropped in place, and the magnet clip 92 is snapped into place by the flexible base or clip portions extending in opposite directions, some of which are in the form of latches 112 and 114. The cover 104 is secured by the screws 106 and 108 to complete the assembly. The magnet clip 92 is protected against removal when the housing 72 is secured to a surface such as a wall or the like by the holes 116 and 118 and corresponding holes on the hidden side of the housing 72. However, a replacement of a coil assembly 90 is readily effected by detaching the housing 72 from the surface to which it is secured, removing the magnet clip 92, the armature 86 and the coil assembly 90 and inserting a new coil assembly 90. This also makes the electromagnet contactor of FIG. 1 easy to adapt for different operating voltages. If it is desired to replace the movable contacts 22 et al. or 46 et al., removing the armature 86 frees the carrier assembly 20 or 44 for replacement of the movable contacts 22 et al. or 46 et al.

Figure 2:
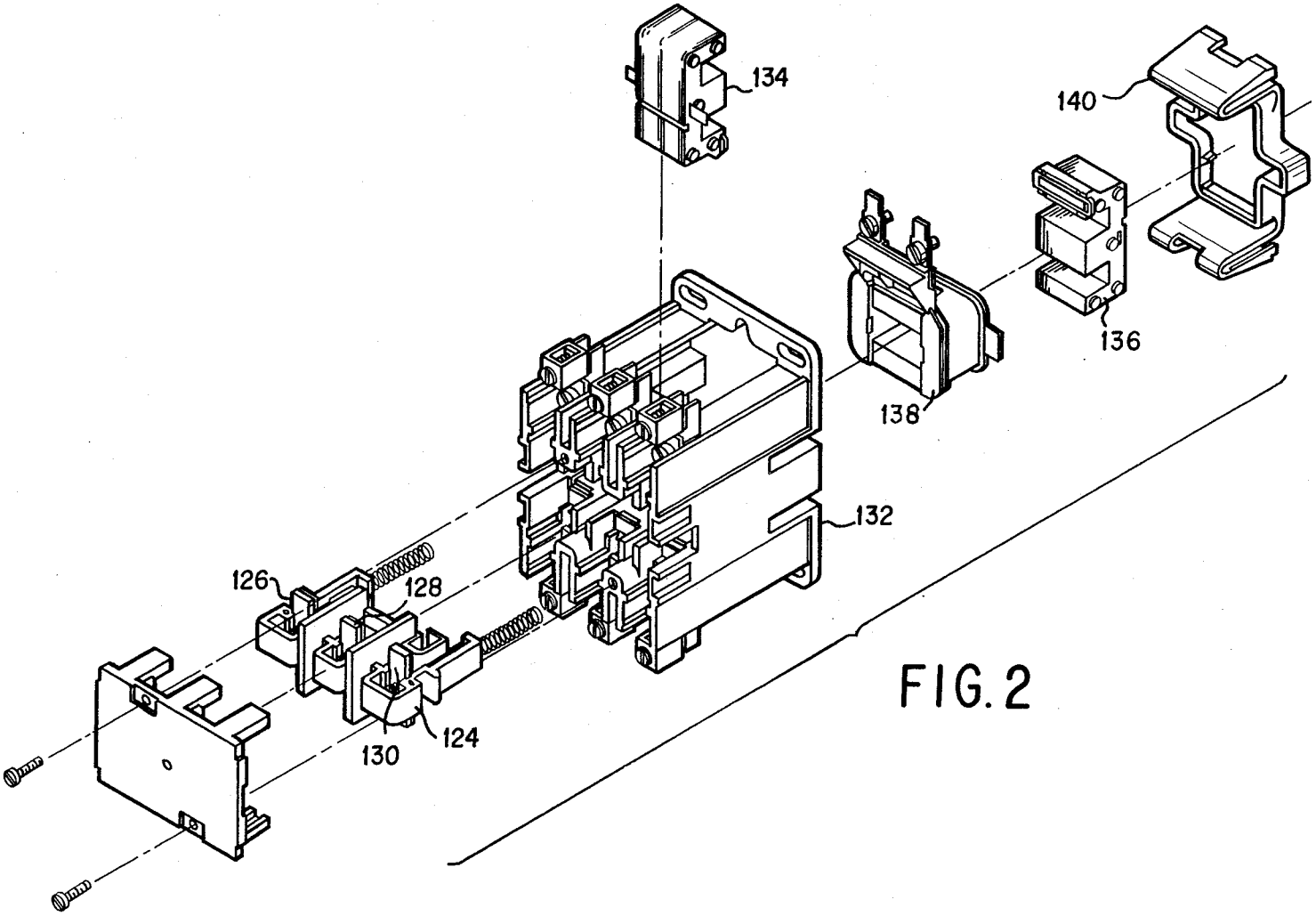
FIG. 2 is an isometric exploded view of a three-pole electromagnetic contactor according to the present invention.

FIG. 2 is similar in many ways to FIG. 1. In FIG. 2, the carrier assembly 124 includes three movable contacts 126, 128, and 130. The housing 132 resembles the housing 72 of FIG. 1 with obvious adaptations and the moving armature 134, fixed armature 136, and coil assembly 138 function as the corresponding elements do in FIG. 1. However, the carrier assembly 124 is adapted only for normally closed contacts. The magnet clip 140 holds the fixed armature 136 and the coil assembly 138 in place in the housing 132 as before and the cover 142 both protects the contacts and also minimizes the possibilities of arcing between adjacent contacts.

The electromagnetic contactors of FIG. 1 and FIG. 2 are typically designed in size ranges of 20 amperes to 60 amperes per terminal or pole. The three-terminal electromagnetic contactor of FIG. 2 is typically used on a three-phase load, whereas the four-terminal contactor of FIG. 1 may be used either with a three-phase load or with two single-phase loads. The latter is certain to be the case when the option of two normally open and two normally closed contacts is used.

Figure 3:
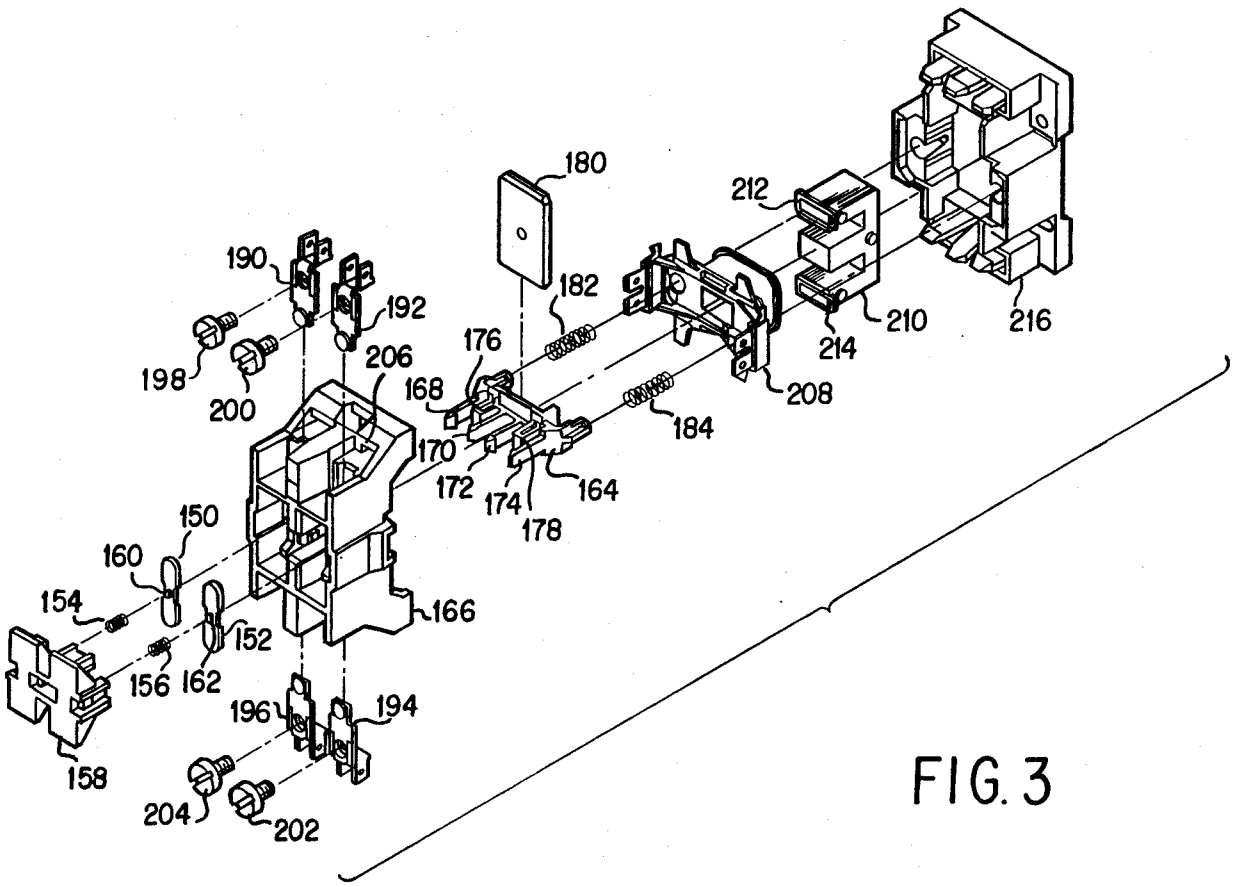
FIG. 3 is an exploded isometric view of a two-pole electromagnetic contactor representing an alternate embodiment of the present invention.

FIG. 3 is an exploded isometric view of an alternate embodiment of the present invention. In FIG. 3, a pair of movable contacts 150 and 152 is biased by a pair of coil springs 154 and 156 respectively that are maintained between cups (not shown) in carrier 158 and bosses 160 and 162 of the movable contacts 150 and 152 respectively. The carrier 158 engages a carrier clip 164 which is connected to it through contact block 166 by latches 168, 170, 172, and 174. When the carrier clip 164 is latched to the carrier 160, the movable contacts 150 and 152 are held in place by two projections 176 and 178 in the carrier clip 164. A solid armature 180 fits into slots (not shown) in the carrier clip 164 and the carrier clip 164 is biased into a normally open position by a pair of coil springs 182 and 184 that engage the carrier clip 164. The movable contacts 150 and 152 are then held away from four stationary contacts 190, 192, 194, and 196. The stationary contacts 190, 192, 194, and 196 are formed to include fast-on connections and also terminal screws 198, 200, 202, and 204. The electromagnetic contactor of FIG. 3 may thus be connected to external wires by fast-on connections that are slipped onto the stationary contacts 190, 192, 194, and 196, or stripped wires may be connected to the terminal screws 198, 200, 202, and 204. The terminal screws 198 et al. also contact the wall 206 of the contact block 166 and the corresponding wall (not shown) on the underside of the contact block 166 in FIG. 3.

The coil springs 182 and 184 pass through holes in the coil assembly 208 which supplies a magnetic field to operate the contactor of FIG. 3. A magnet assembly 210 increases the magnetic flux produced by the coil assembly 208. As before, shading coils 212 and 214 are staked or otherwise secured on the magnet assembly 210 to reduce chattering and hence make the electromagnetic contactor operate more quietly. The assembly is completed with a base 216 which snaps into engagement with the contact block 166. The assembly of FIG. 3 is complete and operable without the use of screws. The base 216 is expected to be latched permanently to the contact block 166, since an electromagnetic contactor such as that of FIG. 3 is typically designed to handle only currents up to the order of 30 amperes. It is not designed to come apart so as to replace the movable contacts 150 and 152, the stationary contacts 190, 192, 194, or 196, or the coil assembly 208, but is intended to be replaced as a unit.

The result of the arrangement of FIG. 3 is that assembly is very simple and is well adapted to automatic assembly machines or robots. Assembly begins by inserting the stationary contacts 190 et al. into the contact block 166 and then inserting the terminal screws 198 et al. The carrier 158 is then placed on a horizontal surface and the coil springs 154 and 156 are dropped in place. The movable contacts 150 and 152 are then inserted on the coil springs 154 and 156 with the bosses 160 and 162 holding them in place. The contact block 166 is next placed over the equipment previously assembled and the carrier clip 194, after insertion of the armature 180, is latched into place in the carrier 158. The coil springs 182 and 184 are next inserted on the carrier clip 164, the coil assembly 208 is dropped in place, the magnet assembly 210 is inserted in the coil assembly 208, and the base 216 is snapped into place after the stationary contacts and terminal screws were inserted and the contact block 166, the only operation that was not performed in a straight vertical line was the insertion of the armature 180. This arrangement of components is thus readily adaptable for automatic manufacture.

Figure 4:
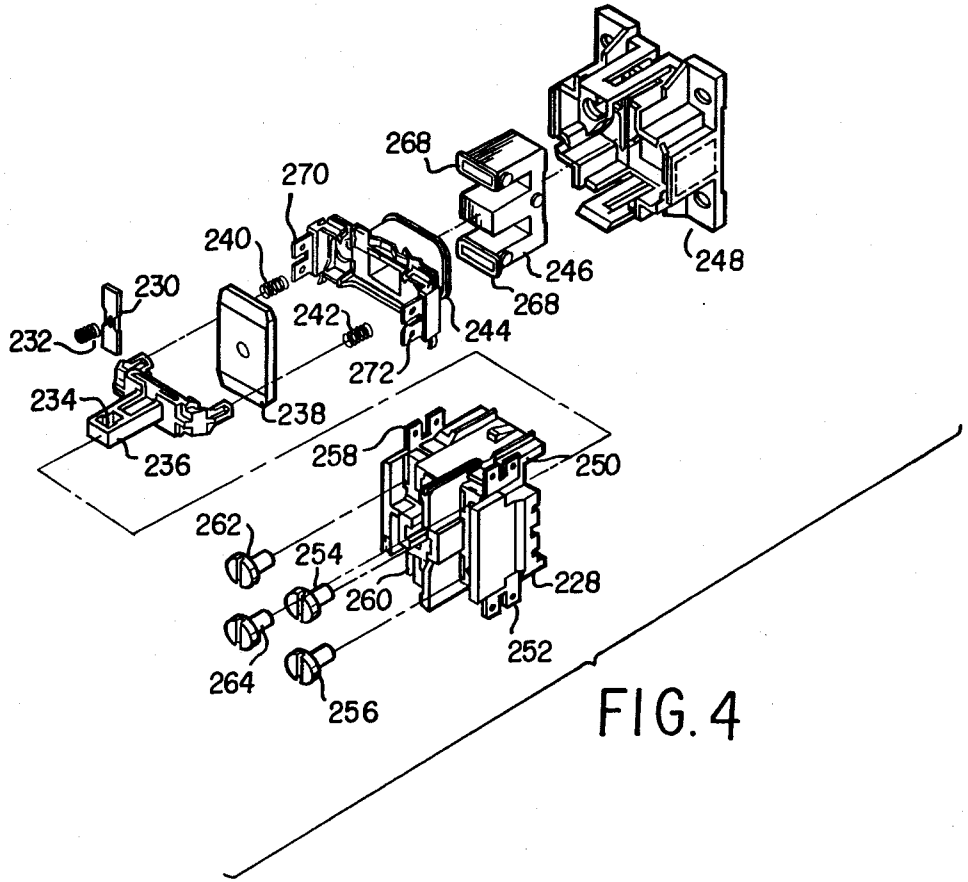
FIG. 4 is an exploded isometric view of a one-pole electromagnetic contactor representing a second alternate embodiment of the present invention.

FIG. 4 is an exploded isometric view of a second alternative embodiment of the present invention. FIG. 4 shows a one-pole electrical contactor. In FIG. 4, the housing assembly 228 is disposed to provide sliding motion to a movable contact 230 that is held by a coil spring 232 in a slot 234 of a contact carrier 236. An armature 238 is slid into engagement with the contact carrier 236, and the contact carrier 236 is then inserted in the housing assembly 228 to place the movable contact 230 in the coil spring 232. The pair of coil springs 240 and 242 extend through holes in the coil assembly 244 which supplies a magnetic field to the magnet assembly 246. The coil springs 240 and 242 are received by the base 248, against which they assert a force to hold the contact carrier 236 apart from the housing assembly 228. The housing assembly 228 has a first terminal 250 that is connected by a short circuit to a second terminal 252. Terminals 250 and 252 are placed for wiring convenience. They have fast-on bayonet connectors as shown in FIG. 4 and may or may not have terminals screws 254 and 256 for use in connecting stripped wires. When an electromagnetic contactor such as the one-pole contactor of FIG. 4 is specified for operation of a refrigerator or other such appliance, the designer may order or omit the terminal screws 254 and 256. A terminal 258 includes a fixed contact, as does the terminal 260. The movable contact 230 is moved into engagement with the terminals 258 and 260 to close the contact of the electromagnetic switch of FIG. 4. Terminal screws 262 and 264 may be included or may be omitted as with the terminal screws 254 and 256.

The magnet assembly 246 of FIG. 4 includes a pair of shading coils 266 and 268 which reduce buzz or chatter when the magnet assembly is powered by an AC voltage. The magnet assembly 246 has a pair of fast-on bayonet connection terminals 270 and 272, to which an AC voltage is applied to operate the electromagnetic contactor of FIG. 4. While the contactor of FIG. 4 has the movable contact 230 exposed, it would be a simple matter to extend the housing assembly 228 a sufficient distance to clear the contact carrier 236 in its off position and support a cover. This is not shown in FIG. 4, nor is the staking of the first terminal 250, the second terminal 252 and the terminals 258 and 260 to housing assembly 228 to hold them in position.

Assembly of the electromagnetic contactor of FIG. 4 begins by sliding the armature 238 into place on the contact carrier 236 which is then inserted in the housing assembly 228 where it is held by inserting the movable contact 230 into the slot 234 and inserting the coil spring 232. The magnet assembly 246 is next placed in the base 248, and the coil assembly 244 is placed on the magnet assembly 246. The springs 240 and 242 are placed through holes in the coil assembly 244, and the housing assembly 228 is snapped into place.

Figure 6:
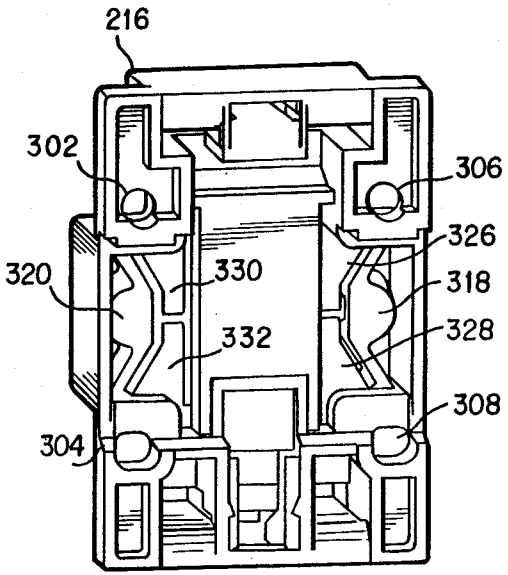
FIG. 6 is an offset bottom view of the base of FIG. 3.
Figure 5:
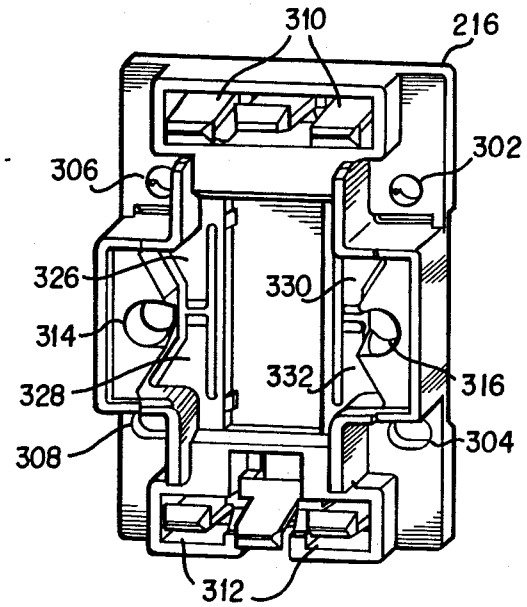
FIG. 5 is an offset top view of the base of FIG. 3.

FIG. 5 is an offset top view and FIG. 6 is an offset bottom view of the base 216 of FIG. 3. In FIGS. 5 and 6, a series of mounting holes 302, 304, 306 and 308 is molded in the base 216 to facilitate mounting it to a horizontal surface. Molded flexible portions extending in opposite directions, in the form of latches 310 and 312 engage the contact block 166 of FIG. 3 to hold the electromagnetic contactor together. The coil springs 182 and 184 of FIG. 3 engage the cups 314 and 316 of FIG. 5. FIG. 6 shows the underside 318 of cup 314, and underside 320 of cup 316. Four cantilevered supports 326, 328, 330 and 332 are shown from the top in FIG. 5 and from the bottom in FIG. 6. Because they are cantilevered, these supports provide springing action. The coil assembly 208 of FIG. 3 is thus pushed against the contact block 166 by the cantilever force. Clearance between the contact block 166 and the base 216 from permits the coil assembly 208 to move in response to the magnetic forces developed in operating the electromagnetic contactor.

In the embodiments of the present invention that have been made and used, the carrier assemblies 20 and 44, the housing 72 and the cover 104 were made by injection molding of polyethylene terphthalate, an engineering plastic that is dimensionally stable, is adequately elastic and is an electrical insulator. The corresponding components in FIGS. 2, 3 and 4 were made of the same material. It is obvious that any dimensionally stable moldable plastic that is electrically insulating would suffice. The magnet clips 92 of FIG. 1, and 140 of FIG. 2, and the bases 216 of FIG. 3 and 248 of FIG. 4, were made of a glass-reinforced polycarbonate. The fixed and movable contacts were made of copper with silver-cadmium oxide buttons welded in place where they meet to make electrical contact. Terminal screws were copper. Each of the shading coils was a one-turn copper loop that was staked in place. Polyethylene terphthalate and glass-reinforced polycarbonate are serviceable materials and are the ones that were used, but any moldable plastic with adequate physical strength, dimensional stability, elasticity and high electrical resistance would suffice.

While the present invention has been described in terms of specific embodiments, it should be understood that these embodiments are illustrative and should not be taken as limiting. The scope of the invention should be limited only in accordance with the following claims.

What is claimed is:

1. In an electromagnetic contactor having a housing, a fixed contact connected to the housing, a moving contact, a contact carrier that holds the moving contact and moves the contact carrier with respect to the housing to make and break an electrical connection between the fixed contact and the moving contact, a movable armature connected to the contact carrier, and a coil assembly disposed to produce a magnetic field in the armature when an electric current is passed through the coil assembly, the improvement comprising:

(a) a stationary armature in the coil assembly to exert a magnetic field in the movable armature when the electric current is passed through the coil assembly; and (b) a base that snaps into the housing to secure the stationary armature and the coil assembly in a predetermined location in the housing, said base having two flexible portions which extend in opposite directions, which move relative to the housing as the base is inserted into the housing, and which engage the housing when the base is fully inserted in the housing.

2. The electromagnetic contactor of claim 1 wherein the stationary armature is formed of a plurality of laminations of a ferromagnetic material that are secured together.

3. The electromagnetic contactor of claim 2 comprising in addition a shading coil affixed to the stationary armature.

4. The electromagnetic contactor of claim 1 wherein the magnet clip is made of glass-reinforced polycarbonate.

5. In an electromagnetic contactor having a housing, a fixed contact connected to the housing, a moving contact, a contact carrier that holds the moving contact and moves the contact carrier with respect to the housing to make and break an electrical connection between the fixed contact and the moving contact an armature connected to the contact carrier, a coil assembly disposed to produce a magnetic field in the armature when an electric current is passed through the coil assembly, the improvement comprising:

(a) a base adapted to snap into locking engagement with the housing, the base including a plurality of cantilevered portions disposed to apply a spring force to the coil assembly.

6. The electromagnetic contactor of claim 5 wherein the base is made of glass-reinforced polycarbonate.

7. In an electromagnetic contactor having a housing, a fixed contact connected to the housing, a moving contact, a contact carrier that holds the moving contact and moves the contact carrier with respect to the housing to make and break an electrical connection between the fixed contact and the moving contact, a movable armature connected to the contact carrier, and a coil assembly disposed to produce a magnetic field in the armature when an electric current is passed through the coil assembly, the improvement comprising:

(a) a stationary armature in the coil assembly to exert a magnetic field in the movable armature when the electric current is passed through the coil assembly; and (b) a clip that snaps into the housing to secure the stationary armature and the coil assembly in a predetermined location in the housing, said clip having two flexible portions which extend in opposite directions, which move relative to the housing as the clip is inserted into the housing, which engage the housing when the clip is fully inserted, and which are accessible externally of the housing to release the clip from the housing so that the stationary armature and coil assembly can be readily removed from the housing.

* * * * *